United States Patent [19]

Logan

[11] Patent Number: 4,834,276

[45] Date of Patent: May 30, 1989

[54] WEB LOADING AND FEEDING SYSTEM, RELATED WEB CONSTRUCTION AND METHOD AND APPARATUS FOR MAKING WEB

[75] Inventor: David J. Logan, Glastonbury, Conn.

[73] Assignee: Gerber Scientific Products, Inc., Manchester, Conn.

[21] Appl. No.: 529,960

[22] Filed: Sep. 6, 1983

Related U.S. Application Data

[63] Continuation-in-part of Ser. No. 520,807, Aug. 5, 1983, abandoned.

[51] Int. Cl.[4] ..... B65H 20/20

[52] U.S. Cl. ..... 226/76

[58] Field of Search ..... 226/74, 76, 53, 157, 226/87, 123; 242/56.8; 83/202, 238, 263, 401, 684, 734, 234, 82, 108, 221, 405, 423; 400/613.1, 616.3, 619; 33/18 B, 18.2; 346/139 B, 139 C, 140 R; 281/5, 6, 8, 11; 282/3 B, 15 B, 16 B, 18 A, 20 B, 21 D, 7

[56] References Cited

U.S. PATENT DOCUMENTS

| | | | |
|---|---|---|---|
| 911,236 | 2/1909 | Groebli | 242/56.8 |
| 1,065,133 | 6/1913 | Ivatts | 281/5 |
| 1,158,767 | 11/1915 | Amrhein | 242/56.8 X |
| 1,368,994 | 2/1921 | Johnson | 282/21 D |
| 1,944,387 | 1/1934 | Wright . | |
| 2,351,075 | 6/1944 | Schultz | 400/619 X |
| 2,500,196 | 3/1950 | Metzner | 226/87 |
| 3,058,638 | 10/1962 | Christoff et al. | 226/76 |
| 3,146,283 | 8/1964 | Da Valle | 242/56.8 X |
| 3,360,210 | 12/1967 | Frisbie | 242/56.8 X |
| 3,640,481 | 2/1972 | Pugh | 242/56.8 |
| 3,706,249 | 12/1972 | Bruckner | 83/411 R X |
| 3,809,410 | 5/1974 | Johnson et al. | 281/5 |
| 3,857,525 | 12/1974 | Gerber et al. | 346/139 B X |
| 3,987,884 | 10/1976 | Buxton | 400/619 X |
| 3,993,814 | 11/1976 | Cavender | 281/5 X |
| 4,026,405 | 5/1977 | de Poncins | 400/616.3 X |
| 4,307,897 | 12/1981 | Sarkans et al. | 282/21 D X |
| 4,467,525 | 8/1984 | Logan et al. | 33/18 B |

FOREIGN PATENT DOCUMENTS

| | | | |
|---|---|---|---|
| 565090 | 10/1944 | United Kingdom | 226/76 |
| 632590 | 11/1949 | United Kingdom | 226/76 |

*Primary Examiner*—Harvey C. Hornsby
*Assistant Examiner*—Scott J. Haugland
*Attorney, Agent, or Firm*—McCormick, Paulding & Huber

[57] ABSTRACT

In a machine, such as a plotter or sign maker, wherein the web is fed longitudinally of itself by a pair of feed sprockets two corresponding pins of the two sprockets are visually distinguished from the other pins and at intervals along the length of the web corresponding holes on opposite sides of the web are visually distinguished from the other holes to enable a pair of such distinguished web holes to be loaded onto the pair of distinguished sprocket pins, thereby assuring proper loading of the web onto the machine and eliminating the possibility of subsequent faulty operation of the machine due to web misloading. The distinguished pairs of web holes are so distinguished by extra holes in the web and the distinguished pair of pins of the two sprockets are so distinguished by extra pins on the sprockets or by causing the two distinguished pins to have a color or other visual characteristic different from that of the other pins.

14 Claims, 7 Drawing Sheets

WEB LOADING AND FEEDING SYSTEM, RELATED WEB CONSTRUCTION AND METHOD AND APPARATUS FOR MAKING WEB

CROSS-REFERENCE TO RELATED APPLICATION

This application is a continuation-in-part of U.S. patent application Ser. No. 520,807, filed Aug. 5, 1983, now abandoned.

BACKGROUND OF THE INVENTION

This invention relates to web handling machines such as plotters, recorders and sign makers wherein a web is fed longitudinally of itself by a pair of sprockets cooperating with holes in the two longitudinal side edge portions of the web, and deals more particularly with a web loading and feeding system for such a machine, including a related web construction and a method and apparatus for making the web, facilitating by way of visual aids the proper loading of a web onto the machine.

The present invention may be used with any one of various types of machines wherein a web is moved by a pair of sprocket wheels having pins, or teeth-like members, on their peripheries cooperating with rows of feed holes in the web's two side edge portions. In such machines it is usually essential to error free operation that the web be properly loaded in the machine so that the sprocket pins engage the correct web holes. This means that two corresponding pins of the two sprockets located in a common plane passing through the sprocket drive axis should engage two corresponding feed holes of the web located on a common line extending perpendicular to the edges of the web. Often, particularly when the web is very wide, it is difficult to determine by eye which sprocket pins correspond with one another and which holes on the opposite sides of the web correspond with one another, and as a result web loading errors can easily occur. Moreover, sometimes when a web loading error is made the web thereafter nevertheless appears to feed in an apparently normal manner so that errors introduced by the web loading may be ascribed to other causes and not quickly traced back to the faulty loading.

A general object of the invention is therefore to provide a visual means to enable a machine operator to easily visually determine the proper placement of a web when loading it onto the feed sprockets of a machine. Although, as mentioned above, this invention may be used with various different types of web handling devices it is particularly well suited for machines such as the sign making machine as shown in copending patent application Ser. No. 401,722, filed July 26, 1982, wherein the web is relatively wide and wherein in the course of a day's operation many different webs may be loaded onto the machine.

The invention also has as an object the provision of a web construction usable with a web handling machine to facilitate proper loading of it into the machine and has as a related object the provision of a method and apparatus for efficiently making such a web.

Other objects and advantages of the invention will be apparent from the following detailed description of the preferred embodiments and from the accompanying drawings.

SUMMARY OF THE INVENTION

The invention resides in a web loading and feeding system for a web handling machine with such system including two drive sprockets each having a series of radially outwardly extending pins uniformly spaced from one another circumferentially of the sprocket with two corresponding pins on the two sprockets—that is, two pins located at least approximately in the same plane containing the axis of sprocket rotation—being visually distinguished from the remaining pins, the web having similarly uniformly spaced feed holes located in rows extending along each of the side edge portions of the web with corresponding holes—that is, two feed holes on opposite sides of the web located in substantially the same line extending perpendicular to the side edges of the web—at intervals along the length of the web being visually distinguished from the remaining feed holes by means of extra indicator holes, so that the visually distinguished web feed holes may be placed on the visually distinguished sprocket pins to assure proper web loading. The distinguished pair of sprocket pins may be so distinguished by means of extra pins engaging the extra holes of the web, or other visual means such as color differences may be used to provide the distinguishing features.

The invention also resides in the construction of the web by itself whereby in addition to a row of first feed holes extending along one side edge portion of the web and a row of second feed holes extending along the other side edge portion of the web the first side edge portion includes third holes and the other side edge portion of the web includes fourth holes which third and fourth holes serve feed to visually distinguish corresponding pairs of first and second feed holes to aid in properly locating the web onto a handling machine.

The invention still further resides in a method and apparatus for making the web construction whereby the holes in the side edge portions of the web are made by a simple punch, step motor drive and control apparatus.

DETAILED DESCRIPTION OF THE PREFERRED EMBODIMENT

Figure 1:
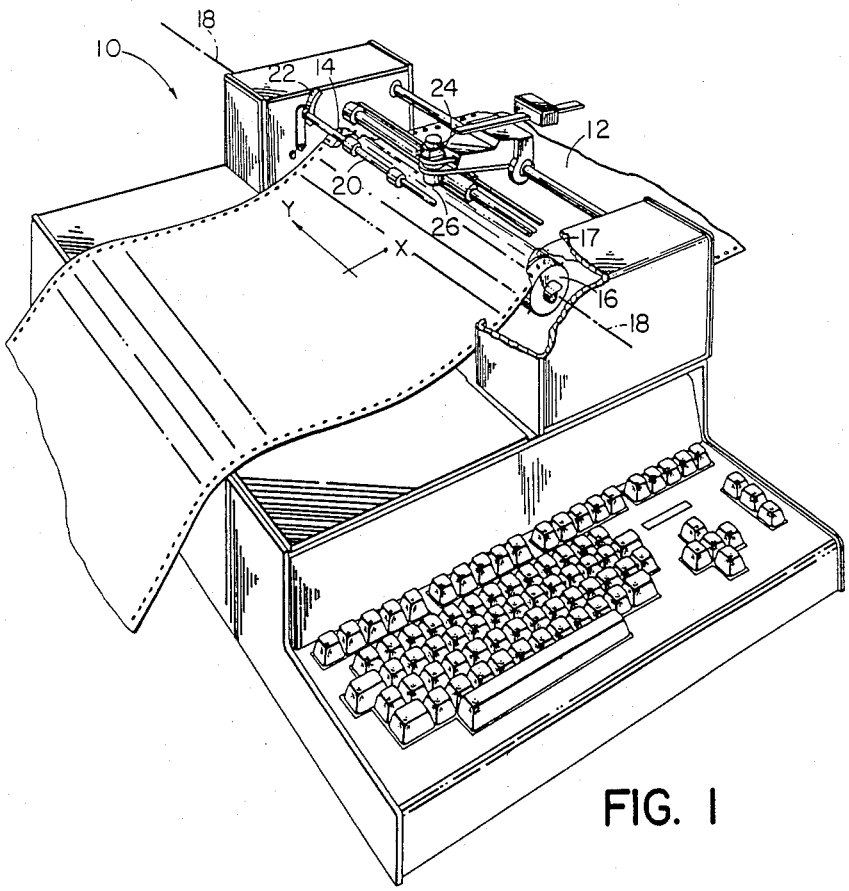
FIG. 1 is a perspective view of a sign making machine having a web loading and feeding system embodying the present invention with various portions of the machine and of the web being broken away to reveal additional features.
Figure 3:
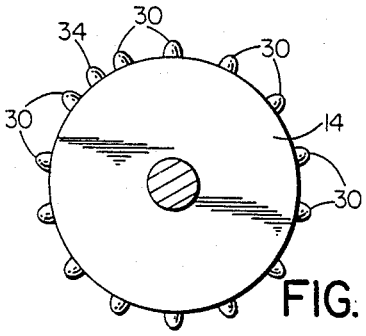
FIG. 3 is a side elevational view of one of the web drive sprockets of FIG. 1.

Referring to FIG. 1, the invention is there illustrated as embodied in a sign making machine 10 which is or may be generally similar to the one shown and described in more detail in copending application Ser. No. 401,722, filed July 26, 1982. The machine 10 handles and works on an associated web 12. The web is moved longitudinally of itself, in the illustrated X-coordinate direction, by a pair of drive sprockets 14, 16 forming part of the machine 10 and spaced from one another along and supported for driven rotation in unison about a common drive axis 18. As explained in more detail hereinafter, pins or teeth on the two sprockets 14, 16 engage feed holes in the two side edge portions of the web 12 to drive it in the X-coordinate direction. A platen or roller 17 located between the two sprockets 14 and 16, and similar to that of a typewriter, supports that transverse portion of the web 12 aligned with the sprockets 14, 16.

When the machine 10 is operating two web hold-down bails, one for each sprocket 14 and 16, carried by a transverse rod 20 normally hold the web in engagement with the sprockets. In FIG. 1 only the one hold-down bail 22 associated with the sprocket 14 is shown and this bail along with its supporting rod 20 is shown in its raised position to give a clearer view of the sprockets.

The machine 10 also includes a tool head 24 suitably supported and driven in the illustrated Y-coordinate direction relative to the web 12.

In a normal sign making mode of operation, the tool head 24 is equipped with a knife-type cutter 26 and the web 12 is an elongated piece of sign making stock consisting of an upper layer of adhesive-backed plastic material, such as vinyl, supported by a bottom layer of release material on which the upper plastic layer is supported with its adhesive-backed face in engagement with the release material. For example, in this case the basic material from which the web 12 is made may be a laminated sheet material made and sold under the name "SCOTCHCAL" by 3M Corporation. This "SCOTCHCAL" has an upper vinyl layer, usually three to five mils thick, made in various different colors, with a pressure-sensitive adhesive on its lower surface, such vinyl upper layer being in turn carried by a lower release layer in the form of a ninety-pound paper coated with silicone. With the web 12 made of such sign making stock and with the tool head 24 equipped with a knife-type cutting tool 26 the web 12 and the tool 26 may be moved relative to one another simultaneously in the X- and Y-coordinate directions, through the operation of the machine 10, to cut alphanumeric characters or other indicia from the upper vinyl layer of the stock which characters or indicia can subsequently be transferred, as described in the aforesaid pending patent application, to another carrier to form a finished sign.

Also, in addition to the aforedescribed cutting or sign making mode of operation of the machine 10 it may also be operated in a plotting mode during which a pencil or other plotting tool is placed in the work head 24 in place of the cutting tool 26 and the web 12 is comprised of a sheet of paper or the like. In both the sign making mode and the plotting mode the machine 10 operates automatically to cause the tool carried by the head 24 to automatically trace characters or other indicia desired for a sign. The purpose of the plotting mode is to allow a proposed sign to be first plotted on paper to check the results of the information entered into the machine before the more expensive sign making stock is cut.

Proper operation of the machine 10 requires that the web 12 be loaded into it—that is, onto the sprockets 14 and 16—so that as the web is moved longitudinally of itself by rotation of the sprockets lines extending transversely of the web perpendicular to its side edges are parallel to the sprocket axis 18. Typically, the web 12 may be relatively wide—say fifteen inches wide—and the feed holes formed in each side edge portion of the web may be relatively closely spaced to one another—say on one-half inch centers. With such large width of the web and small spacing of the feed holes it is difficult to visually properly align the web with the sprocket pins when loading a web onto the machine. That is, assuming the holes on one side edge of the web are properly located relative to the pins of its associated sprocket the holes along the other side edge of the web may be placed on the wrong pins of the associated sprocket, and such error in the loading of the web may not be readily detected in the subsequent operation of the machine even though it introduces errors in the cutting or plotting function.

In accordance with the invention, the machine 10 and web 12 of FIG. 1 are constructed to provide a web loading and feeding system whereby web loading errors of the type described above can be reduced or eliminated through the use of visual means facilitating proper web loading.

Figure 2:
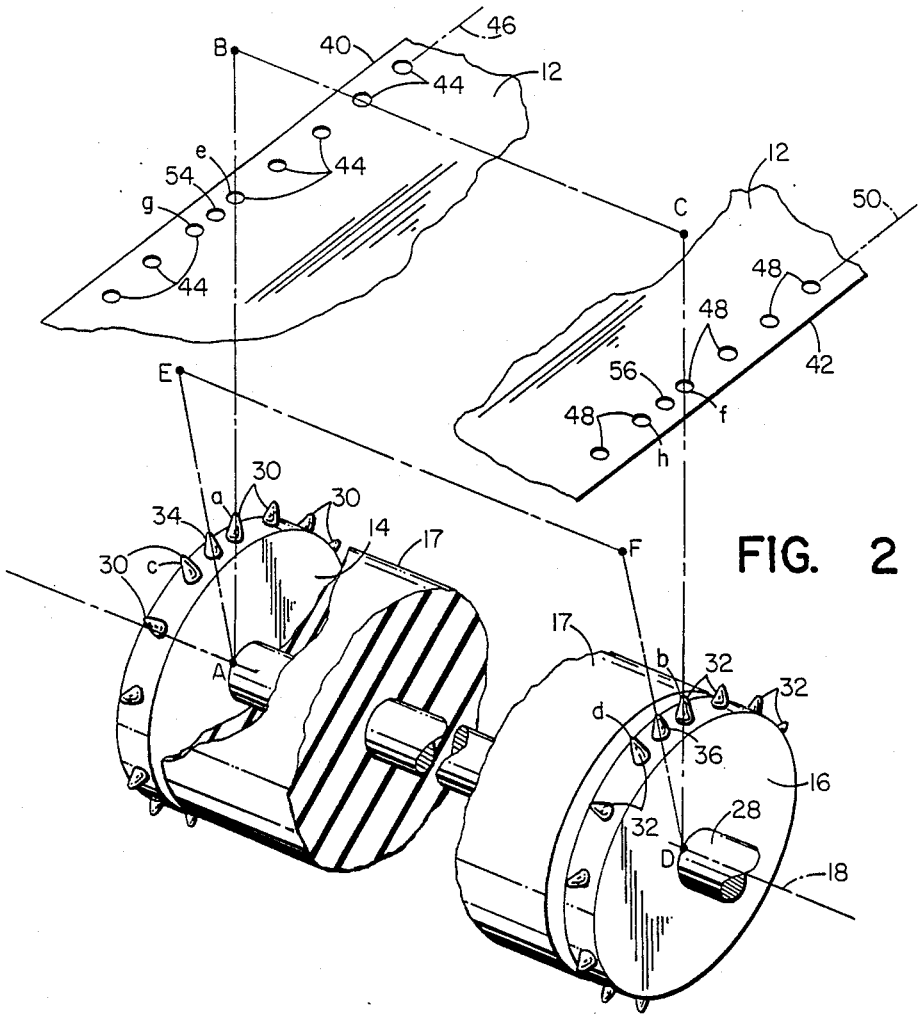
FIG. 2 is a fragmentary perspective view showing the relationship between the drive sprockets and the web during the loading of the web onto the machine of FIG. 1.

Referring to FIG. 2, in the web loading and system of the invention the two sprockets 14 and 16 are both fixed to a common drive shaft 28 for rotation about the common axis 18. The sprocket 14 has a series of radially outwardly extending pins 30, 30 located in a common plane perpendicular to the axis 18 and uniformly spaced from one another circumferentially of the sprocket. The sprocket 16 in turn has a similar series of radially outwardly extending pins 32, 32 located in a common plane perpendicular to the axis 18 and uniformly spaced from one another circumferentially of the sprocket 16 in a manner identical to the spacing of the pins 30, 30 of the sprocket 14. The number of pins 30, 30 on the sprocket 14 is therefore equal to the number of pins 32, 32 on the sprocket 16. This number of pins may vary from application to application, but in the illustrated case the sprocket 14 has fourteen pins 30, 30 and the sprocket 16 likewise has fourteen pins 32, 32. Further, the pins 30, 30 of the sprocket 14 and the pins 32, 32 of the sprocket 16 are so relatively arranged that each pin 30 on the sprocket 14 has a corresponding pin 32 on the sprocket 16 which two pins are located in, or at least substantially in, a common plane passing through the axis 18. For example, in FIG. 2 one such common plane is shown at ABCD and contains a pair of corresponding pins 30 and 32 indicated at a and b.

In keeping with the invention means are provided for visually distinguishing at least one pair of corresponding pins 30 and 32 from the remaining pins 30, 30 and 32, 32 of the sprockets 14 and 16. Such visual distinguishing means may take various different forms and in FIG. 2 consists of an extra, or third, pin 34 on the sprocket 14 and an extra, or fourth, pin 36 on the sprocket 16. The pin 34 on the sprocket 14 is located between two of the pins 30, 30 and likewise the pin 36 on the sprocket 16 is located between two of the pins 32, 32 on the sprocket 16 with the pins 34 and 36 being located in a common plane, such as the plane indicated at AEFD, containing the axis 18. The two extra pins 34 and 36 therefore visually distinguish from the remaining pins 30, 30 and 32, 32 at least one corresponding pair of pins 30 and 32. In FIG. 2 such visually distinguished pair of pins 30 and 32 may be taken to be the pins a and b located clockwise from the pins 34 and 36. However, the distinguished pair of corresponding pins could also be taken to be the pins c and d located counterclockwise from the pins 34 and 36. In FIG. 2 the pin 34 is located midway between two of the pins 30, 30 on the sprocket 14 and the pin 36 is located midway between two of the pins 32, 32 on the sprocket 16. Such middle spacing of the pins 34 and 36 is not, however, necessary and if desired the pin 34 may be located closer to one of the two pins 30 between which it is placed than it is to the other of such two pins and likewise the pin 36 may be located similarly closer to one of the two pins 32 between which it is located than it is to the other of such two pins.

Figure 6:
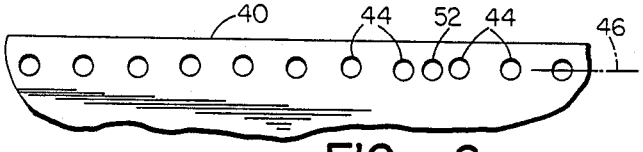
FIG. 6 is an enlarged scale, fragmentary plan view of the web of FIG. 4.
Figure 4:
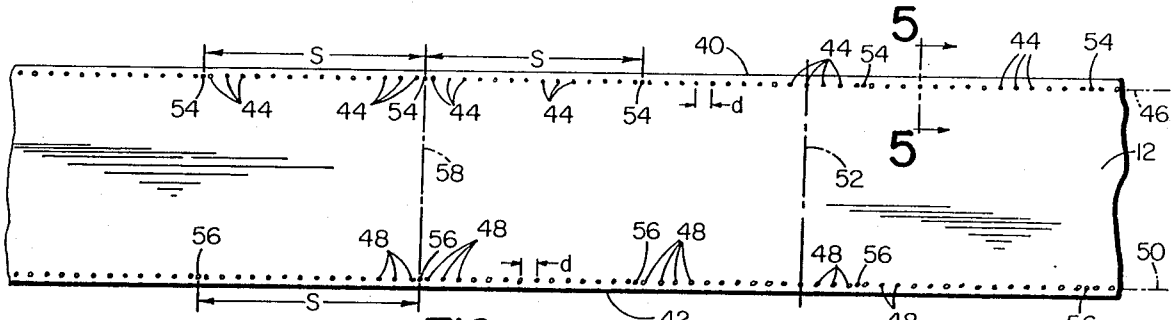
FIG. 4 is a reduced scale plan view of a portion of the web of FIG. 1.

The web 12, as shown in FIGS. 2, 4 and 6 comprises an elongated piece of sheet-like material having parallel side edges 40 and 42. In the side edge portion of the web 12 adjacent the side edge 40 is a row of first feed holes 44, 44 all located on a first line 46 spaced slightly inwardly from the edge 40 and uniformly spaced from one another by a spacing equal to the spacing between the pins 30, 30 of the sprocket 14. Likewise, in the marginal edge portion adjacent the edge 42 is another row of second feed holes 48, 48 all located on a line 50 spaced slightly inwardly from the edge 42 and uniformly spaced from one another by a spacing equal to that of the spacing of the first holes 44, 44. Furthermore, the first holes 44, 44 are so placed relative to the second holes 48, 48 that each first hole 44 has a corresponding second hole 48 located directly opposite from it on the other side of the web. That is, as indicated by the one line 52 indicated in FIG. 4 which extends perpendicular to the side edges 40 and 42, each first hole 44 has a corresponding second hole 48 with such two corresponding first and second holes being located on a common line extending perpendicular to the web side edges and perpendicular to the lines 46 and 50 containing the rows of holes. Also, as seen in FIG. 4, the web between the row of first holes 44, 44 and the row of second holes 48, 48 has a work portion which is completely uniform along its entire length. That is, it has no fold lines, lines of perforations, or markings dividing it into pages or sections. Therefore, a sign of any indefinite length, up to the total length of the web, may be generated on the web by the machine 10.

As part of the invention, the web 12 in addition to the first feed holes 44, 44 and second feed holes 48, 48 includes additional indicator holes serving to visually distinguish corresponding pairs of first and second feed holes at intervals along the length of the web. In FIGS. 2, 4 and 6 these additional indicator holes comprise a row of third holes 54, 54 located on the same line 46 as the first holes 44, 44 and a row of fourth holes 56, 56 located on the same line 50 as the second holes 48, 48. Each third hole 54 is located between two adjacent first holes 44, 44 and each fourth hole 56 is located between two adjacent second holes 48, 48. Further, the placement of each third hole 54 with respect to the two first holes 44, 44 between which it is received conforms to the placement of the third pin 34 of the sprocket 14 between the two pins 30, 30 between which it is received. Similarly, the placement of each fourth hole 56 with respect to the two second holes 48, 48 between which it is received conforms to the placement of the fourth pin 36 of the sprocket 16 with respect to the two pins 32, 32 between which it is received.

Also, still referring to FIGS. 2 and 4, each third hole 54 has a corresponding fourth hole 56 located directly opposite from it along a common line extending perpendicular to the side edges 40, 42 of the web and to the lines 46 and 50, one such common line being shown for example at 58 in FIG. 4. It will therefore be evident from FIGS. 2 and 4 that each pair of corresponding third and fourth indicator holes 54 and 56 serve to visually distinguish at least one corresponding pair of first and second feed holes 44 and 48. For example, in FIG. 2 the illustrated corresponding third and fourth holes 54 and 56 visually distinguish one pair of first and second holes indicated at e and f. They also serve to visually distinguish another pair of first and second holes indicated at g and h. Since in the construction shown the third hole 54 as seen in FIG. 2 is placed equidistantly between the holes e and g and the fourth hole 56 is placed equidistantly between the holes f and h the corresponding pair of first and second holes made up of the holes e and f are visually distinguished from the remaining first and second holes to the same extent as are the corresponding pair made up of the holes g and h. Therefore, the three holes e, g and 54 of FIG. 2 may be taken to be a cluster of holes which cluster is itself visually distinguished from the remaining holes 44, 44 and is placed over the corresponding cluster of pins on the sprocket 14 made up of the pin 34 and the two pins a and c on opposite sides of it when loading the web onto the sprocket 14, and likewise the holes h, f and 56 may be taken to be a similar visually distinguished cluster of holes which is placed on the visually distinguished cluster of pins on the sprocket 16 made up of the pin 36 and the two pins b and d on opposite sides of it. However, if desired the hole 54 may be placed closer to the hole e and the hole 56 closer to the hole f than shown in FIG. 2 to give distinctive prominence to the corresponding first and second holes e and f and in such case the pins 34 and 36 would of course also be located closer to the corresponding pins a and b.

As is obvious from what has already been said, the corresponding pairs of third and fourth indicator holes 54 and 56 distinguish corresponding pairs of first and second feed holes on the web which visually aids in properly loading the web onto the sprockets 14 and 16. That is, in a loading procedure such as illustrated in FIG. 2, the sprockets are turned to bring the third and fourth pins 34, 36 to a web loading position at which the pins 34 and 36 extend generally upwardly. The web 12 is then moved over the sprockets until a corresponding pair of third and fourth holes 54, 56 are located generally above the sprocket pins 34, 36 and then the web is moved downwardly onto the sprockets bringing the holes 54, 56 onto the pins 34 and 36 and bringing the visually distinguished corresponding pair of first and second holes e and f onto the visually distinguished corresponding pair of pins a and b and the visually distinguished corresponding pair of holes g and h onto the visually distinguished corresponding pair of pins c and d, and accordingly proper movement of the web from that point on is assured.

With reference to FIG. 4, the third holes 54, 54 are spaced uniformly from one another along the length of the web by a distance S which distance S is equal to Nd, where d is the spacing between the first holes 40, 40 and is the spacing between the second holes 48, 48, and where N is the number of first pins 30, 30 on the sprocket 14 the number of second pins 32, 32 on the sprocket 16. In the illustrated case the number of pins 30, 30 and 32, 32 is fourteen and therefore S equals 14*d*—that is, a third hole 54 occurs after every fourteenth hole 44 and likewise a fourth hole 56 occurs after every fourteenth hole 48. As a result of this each time the sprockets 14 and 16 undergo one revolution the third and fourth pins 34 and 36 will enter a new pair of third and fourth holes 54 and 56.

Figure 5:
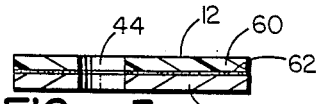
FIG. 5 is an enlarged scale, fragmentary sectional view through the web taken on the line 5—5 of FIG. 4.

As indicated previously the web 12 may take various different forms depending on the type of machine with which the invention is used, and in the illustrated case may be either a length of sign making stock from which signs are cut or may be a length of paper or the like on which a sign is drawn as a test or checking procedure prior to its being cut from sign making stock material. In FIG. 5 the web 12 is shown to comprise a piece of sign making stock such as the "SCOTCHCAL" material previously mentioned. As such it consists of an upper layer 60 made of a thermoplastic material such as vinyl on the order of three to five mil thickness and having an adhesive backing or coating 62. This upper layer is supported on a release layer 64, to which it is releasably held by the adhesive backing 62, which release layer may consist for example of a ninety-pound paper coated or impregnated with silicone to give it its release property.

Figure 10:
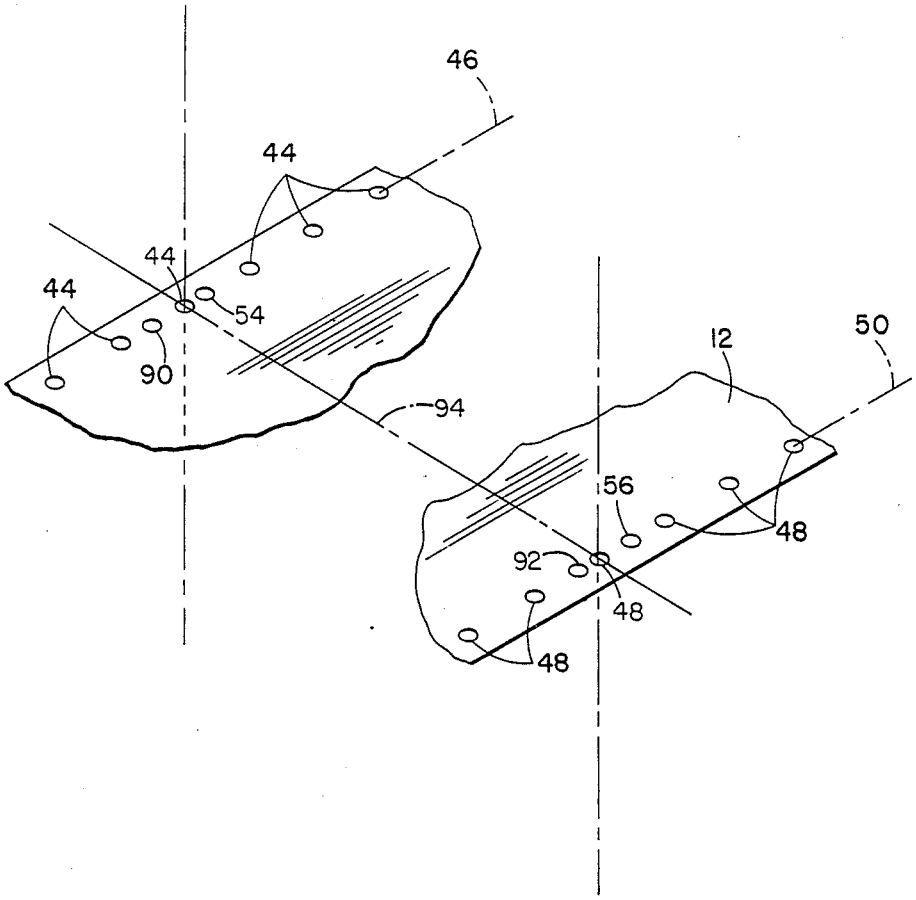
FIG. 10 is a fragmentary perspective view showing another embodiment of the web.

FIG. 10 illustrates another embodiment of the web 12 which is similar to the embodiment of FIG. 2, but includes a row of fifth indicator holes 90 located along the same line 46 as the first holes 44 and a row of sixth indicator holes 92 located along the same line 50 as the second holes 48. Each pair of holes 90, 92 is associated with the same holes 44, 48 as a corresponding pair of holes 54, 56, so that the visually distinguished sets of holes 44, 48 are readily identifiable upon visual observation.

In the embodiment of FIG. 10, however, the holes 54 are not positioned equidistant between the holes 44, but instead, are offset and placed closer to the visually distinguished holes 44 which serve as the keyholes for placing the web on the sprockets. Similarly, the fourth holes 56 are offset and positioned closer to the second holes 48 that are transversely aligned along the perpendicular line 94 with the visually identified holes 44 at the opposite side of the web. The pins on the sprockets engaged by the web, of course, would include visually distinguished pins having the same offset as the holes 54, 56.

With uneven spacing between the holes 54, 56 and the adjacent holes 44, 48, the web 12, in the absence of the holes 90, 92 can only be loaded into the machine 10 with one orientation, that is, the holes 44 must always be engaged with a particular sprocket at one end of the drive shaft 28 and the holes 48 must be engaged with the sprocket at the opposite end of the drive shaft. Any reversal of the holes 44, 48 and the sprockets would result in the offset pins on the sprockets engaging the locations of the web on the side of the perpendicular line 94 opposite from the holes 54, 56. The rows of fifth holes 90 and sixth holes 92 are provided for this reason.

It should be understood that the set of fifth holes 90 and the set of sixth holes 92 need not be transversely aligned with one another provided that the holes 54, 56 have the same misalignment. The fifth holes 90 must be offset from the distinguished hole 44 by the same amount that the fourth hole is offset from the distinguished hole 48, but on the opposite side of the line 94. Correspondingly, the sixth hole 92 must be offset from the second hole 48 by the same amount that the third hole 54 is offset from the visually distinguished hole 44 but on the opposite side of the line 94. With both sets of holes 54, 56 and 90, 92 the web 12 may be loaded into the machine without regard to its orientation or association of the holes at one longitudinal edge of the web with one or the other of the drive sprockets.

Figure 8:
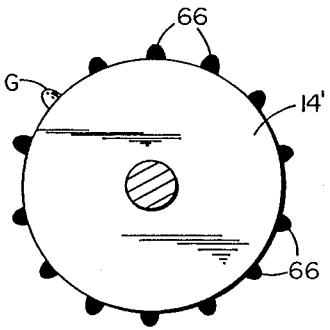
FIG. 8 is a side elevational view of one of the sprocket of FIG. 7.
Figure 7:
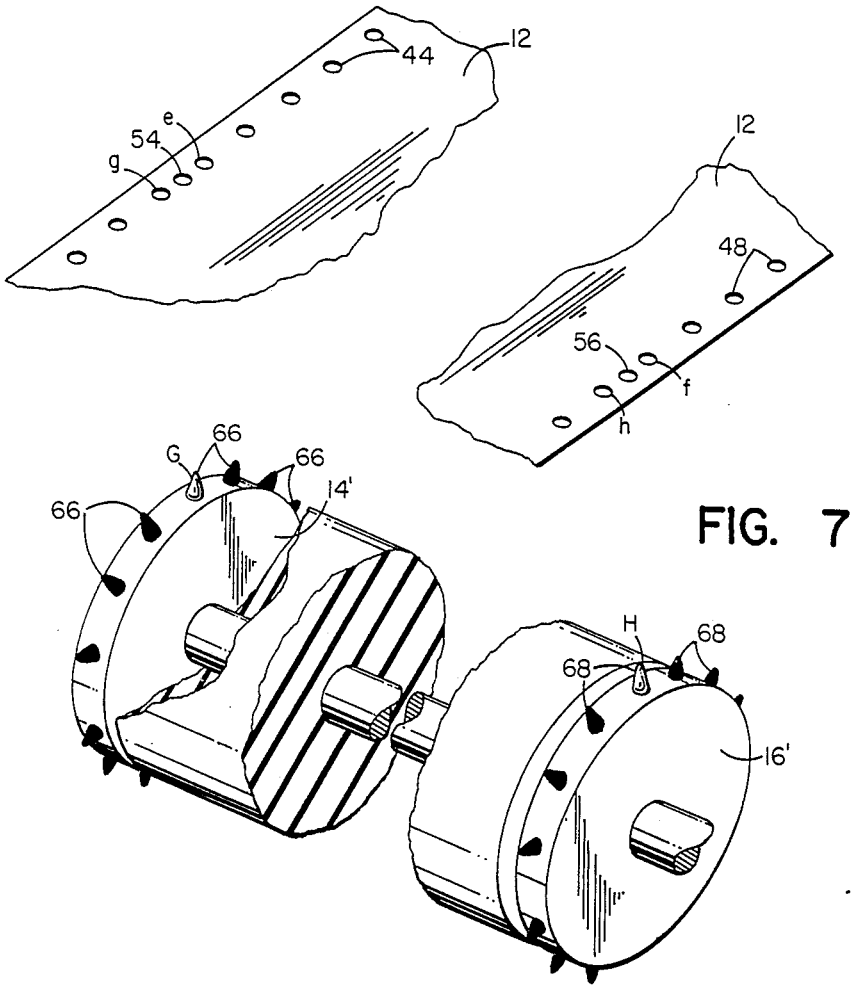
FIG. 7 is a view similar to FIG. 2 but showing a different construction of the sprockets.

Referring to FIGS. 7 and 8, these figures show another embodiment of the invention in which the sprockets 14' and 16' do not include any extra pins and wherein other means are provided for visually distinguishing a pair of first and second pins from the remaining ones of such pins. In particular, the sprocket 14' includes a series of uniformly spaced first pins 66, 66 and the sprocket 16' similarly includes a corresponding series of uniformly spaced second pins 68, 68. On the sprocket 14' one of the first pins 66, 66 is visually distinguished from the others by having an appearance different from that of the others, such visually distinguished pin being indicated at G. Similarly on the sprocket 16' one of the second pins 68, 68, as indicated at H, has a visual appearance distinguishing it from the others. This difference in visual appearance of the pins G and H from that of the other pins 66, 66 and 68, 68 may be achieved in various ways, but preferably and as illustrated, it is accomplished by making the pins G and H of a color distinctly different from the color of the pins 66, 66 and of the pins 68, 68. Such a color difference may be achieved for example by painting the pins G and H and the pins 66, 66 and 68, 68 different colors or by making them of differently colored materials.

The web 12 used with the sprockets 14' and 16' of FIGS. 7 and 8 may be identical to that described above in connection with FIGS. 2 to 6 and is so illustrated in FIG. 7.

Again, as illustrated in FIG. 7, each pair of third and fourth indicator holes 54, 56 of the web serve to visually distinguish two corresponding pairs of first and second feed holes from the remaining ones of such first and second holes of the web. One such pair of distinguished feed holes is the pair indicated at e and f and the other such pair is the pair indicated at g and h. Therefore, to achieve proper loading of the web onto the sprockets either one of such visually distinguished pair of feed holes—that is, the pair e and f or the pair g and h—may be placed onto the visually distinguished pins G and H and thereafter the web will be driven properly by the sprockets as the machine operates.

In the embodiment of FIG. 7 the indicator holes 54, 54 do not receive any corresponding pins of the sprockets 14' and 16' and therefore it is not essential that the spacing of the third holes 54, 54 from one another along the length of the web, or the corresponding spacing of the fourth holes 56, 56 from one another along the length of the web be related to the number of teeth on the sprockets. That is, in the equation $S=Nd$ given above, for the embodiment of FIG. 7 it is not necessary that N be equal to the number of first or second pins on the sprockets but instead it is sufficient that N be some integer other than one.

In accordance with the broader aspects of the invention it is not essential that the first holes 44, 44 of the web all be located exactly on a common line such as the line 46 or that the second holes 48, 48 be located on a common line such as the line 50. Instead, for example, alternate ones of the first holes 44, 44 could be located on opposite sides of the line 46 and alternate ones of the second holes 48, 48 could be located on opposite sides of the line 50, and in conformity with this the first pins 30, 30 of the sprocket 15 could be alternately located on opposite sides of a plane perpendicular to the axis 18 and alternate ones of the second pins 32, 32 could be located on opposite sides of another plane perpendicular to the axis 18 to cause the pattern of the pins 30, 30 and of the pines 32, 32 to match the pattern of the holes 44, 44 and of the holes 48, 48. However, to locate the holes on common lines such as the line 46 and the line 50 does have certain advantages and among other things allows a web 12 to be made from a previously unperforated length of sheet material by a simple punching method and appartaus.

Figure 9:
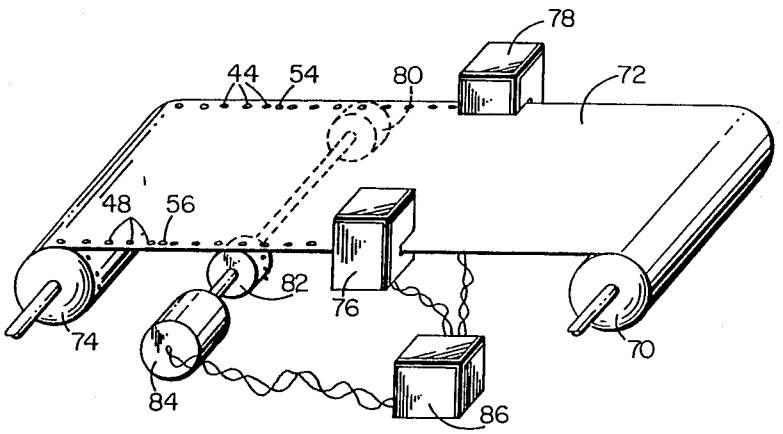
FIG. 9 is a schematic view showing an apparatus for making the web of FIG. 1.

The simple punching method and apparatus referred to in the preceding paragraph is illustrated by FIG. 9. As shown in this figure, the apparatus comprises a supply roll 70 for supplying a quantity of unperforated web material 72, and a take-up roll 74 for rerolling such material after it is punched. Between the supply roll 70 and the take-up roll 74 are two punches 76 and 78 located directly opposite from one another along opposite edges of the web 72 for punching the holes in the opposite side edge portions of the web. Each punch 76 and 78 is of a type which punches one hole in the web 72 during each cycle of operation. Between the punches 76, 78 and the take-up roll 74 are a pair of sprockets 80 and 82, driven in unison by a step motor 84 which engage the holes 44, 44 and 48, 48 formed in the web 72 by the punches to move the web past the punches 76 and 78. The operation of the stepping motor 84 and of the punches 76 and 78 is controlled by a controller 86. In operation the controller 86 commands the stepping motor 84 to move the web a proper distance for the punching of the next pair of corresponding holes by the punches 76 and 78. The motor is then stopped and the punches 76, 78 are then commanded to operate simultaneously to punch two corresponding holes in the opposite sides of the web, and the same cycle is then repeated. The distance the stepping motor moves the web between each punching operation is readily controlled by the controller 86, through preprogramming of it, to achieve proper spacing of the holes 44, 44 and 54, 54 along the one side edge of the web and correspondingly similar spacing of the holes 48, 48 and 56, 56 along the other side edge of the web.

In the claims which follow the work area or portion of the web located between the side edge portions containing the feed and indicator holes is described as being "uniform". By this term "uniform" it is meant that the work area or portion is of a continuous, undifferentiated and uninterrupted nature along the full length of the web so as to contain no perforations, holes, lines of weakening, severings, fold lines or other local features interfering with the generation of a graphic along any selected portion, or entire length, of said web.

I claim:

1. A web loading and feeding system for a machine wherein a web is fed longitudinally of itself by a pair of feed sprockets cooperating with holes in the two longitudinal side edge portions of the web and wherein improper loading of the web onto the sprockets is inhibited, said system comprising a pair of web feed sprockets spaced from one another along a common axis of rotation and supported for driven rotation in unison about said axis, each of said sprockets having a series of radially outwardly extending pins uniformly spaced from one another circumferentially of the sprocket, the spacing of the pins on one of said sprockets being identical to the spacing of the pins on the other of said sprockets and each pin of one sprocket having a corresponding pin on the other sprocket which pin and its corresponding pin are located at least approximately in the same plane containing said axis, means visually distinguishing one pin of one of said sprockets and its corresponding pin on the other of said sprockets from the remaining ones of said pins, and a web to be loaded onto and fed by said two sprockets, said web having a length many times greater than its width, having longitudinally extending side edges and having a first row of first holes in one side edge portion of the web and a second row of second holes in the other side edge portion of the web, said first holes being located on a first line parallel to said side edges and said second holes being located on a second line parallel to said side edges, and said web having a work area located between said side edge portions which work area is completely uniform along the entire length of the web so as to be adapted to have a graphic generated thereon along any selected longitudinal portion thereof, said first holes being uniformly spaced from one another along the length of said web and said second holes being likewise uniformly spaced from one another along the length of said web, the spacing of said first holes and the spacing of said second holes being equal to the spacing between said pins of said sprockets and each of said first holes having a corresponding one of said second holes located at least approximately on the same line extending perpendicular to the side edges of said web, and indicator holes appearing periodically along the lengths of said first and second lines to visually distinguish certain of said first and second holes from other of said first and second holes, there being no holes on said first line between said indicator holes except for a plurality of said first holes and there being no holes on said second line between said indicator holes except for a plurality of said second holes, said indicator holes comprising a third row of third holes in said one side edge portion of said web located on said first line and a fourth row of fourth holes in said other side edge portion of said web located on said second line, said third holes being spaced from one another along the length of said web and said fourth holes also being spaced from one another along the length of said web by a distance $S=Nd$, where S is the spacing between said third holes and is also the spacing between said fourth holes, d is the spacing between said first holes and is also the spacing between said second holes and N is an integer greater than two, said first, second, third and fourth holes all being of similar size and shape, each of said third holes being located between two of said first holes on said first line and each of said fourth holes being located between two of said second holes on said second line, each of said third holes having a corresponding one of said fourth holes located at least approximately on the same line perpendicular to the side edges of said web so that each third hole and its corresponding fourth hole visually distinguish from other of said first and second holes an associated pair of first and second holes located on approximately the same line perpendicular to the side edges of said web and which distinguished pair of first and second holes may be placed on said distinguished pair of pins of said two sprockets to assure a proper loading of said web onto said sprockets.

2. A web loading and feeding system as defined in claim 1 further characterized by said pins of said one sprocket comprising a set of first pins located in a first common plane perpendicular to said axis of sprocket rotation and uniformly spaced from one another circumferentially of the one sprocket and said pins of said other sprocket comprising a set of second pins located in a second common plane perpendicular to said axis of sprocket rotation and uniformly spaced from one another circumferentially of said other sprocket, and said means visually distinguishing one pin of said one sprocket and its corresponding pin of the other of said sprockets comprising a third pin on said one sprocket located in said first common plane and a fourth pin on said other sprocket located in said second common plane, said third pin being located circumferentially between two of said first pins and said fourth pin being located circumferentially between two of said second pins, said third and fourth pins being located in at least approximately the same plane containing said axis of sprocket rotation, the placement of each of said third holes relative to the two of said first holes between which it is located matching the placement of said third pin relative to the two of said first pins between which it is located and the placement of each of said fourth holes relative to the two of said second holes between which it is located matching the location of said fourth pin relative to the two of said second pins between which it is located.

3. A web loading and feeding system as defined in claim 2 further characterized by N being equal to the number of said first pins on said one sprocket and also being equal to the number of said second pins on said other sprocket.

4. A web loading and feeding system as defined in claim 2 further characterized by said web including a fifth hole associated with each of said third holes and a sixth hole associated with each of said fourth holes, each of said fifth holes being located on said first line and each of said sixth holes being located on said second line, each of said fifth holes being spaced from the first hole distinguished by the associated third hole by a spacing equal to the spacing between each fourth hole and the second hole distinguished by such fourth hole but in the opposite direction from said distinguished first hole along said first line, and each of said sixth holes being spaced from the second hole distinguished by the associated fourth hole by a spacing equal to the spacing between the each third hole and the first hole distinguished by such third hole but in the opposite direction from said distinguished second hole along said second line.

5. A web for use with a machine wherein it is fed longitudinally of itelf by a pair of drive sprockets rotatable about a common axis and cooperating with holes in its two longitudinal side edge portions, the drive sprockets each having a circumferential series of uniformly spaced and radially outwardly extending pins with two of said pins, one on each sprocket and both located in approximately the same plane containing said common axis, being visually distinguished from the other of said pins, said web comprising an elongated sheet-like member having parallel side edges and a length many times greater than its width, said web having a first row of first holes in one side edge portion thereof and a second row of second holes in the other side edge portion thereof, said first holes being located on a first line parallel to said side edges and said second holes being located on a second line parallel to said side edges, and said web having a work area located between said first and second edge portions which work area is completely uniform along the entire length of the web so as to be adapted to have a graphic generated thereon along any selected longitudinal portion thereof, said first holes being uniformly spaced from one another along the length of said web and said second holes being likewise uniformly spaced from one another along the length of said web, and indicator holes appearing periodically along the lengths of said first and second lines to visually distinguish certain of said first and second holes from other of said first and second holes, there being no holes on said first line between said indicator holes except for a plurality of said first holes and there being no holes on said second line between said indicator holes except for a plurality of said second holes, said indicator holes comprising a third row of third holes in said one side edge portion of said web located on said first line and a fourth row of fourth holes in said other side edge portion of said web located on said second line, said first, second, third and fourth holes all being of similar size and shape, said third holes being spaced from one another along the length of said web and said fourth holes also being spaced from one another along the length of said web by a distance $S=Nd$, where S is the spacing between said third holes and is also the spacing between said fourth holes, d is the spacing between said first holes and is also the spacing between said second holes and N is an integer greater than two, each of said third holes being located between two of said first holes on said first line and each of said fourth holes being located between two of said second holes on said second line, each of said third holes having a corresponding one of said fourth holes located at least approximately on the same line perpendicular to the side edges of said web so that each third hole and its corresponding fourth hole visually distinguish from other of said first and second holes an associated pair of first and second holes located on approximately the same line perpendicular to the side edges of said web, a pair of such visually distinguished first and second holes when placed on the visually distinguished pins of said sprockets during the placement of said web onto the sprockets therefore establishing a predetermined relationship between the sprockets and said web.

6. A web as defined in claim 5 further characterized by it comprising an elongated sheet-like member for use in making signs and consisting of an adhesive-backed layer of first material supported on a layer of release material with its adhesive-backed face in engagement with the layer of release material, both said layer of first material and said layer of release material extending uninterruptedly the full length of said web.

7. A web as defined in claim 5 further including a fifth row of fifth holes in said one side edge portion of said web and a sixth row of sixth holes in said other side edge portion of said web, said fifth holes being spaced from one another along the length of the web and said sixth holes also being spaced from one another along the length of said web by a distance $S=Nd$, each of said fifth holes and a corresponding one of the sixth holes being located at least approximately on a common line perpendicular to the side edges of said web and being associated with a pair of first and second holes visually distinguished by a corresponding pair of third and fourth holes, the fifth hole being located on the side of said line on which the first and second holes are located opposite from said third hole and otherwise bearing the same association with the first hole as the fourth hole bears to the second hole, and the sixth hole being located on the side of said line on which the first and second holes are located opposite from said fourth hole and otherwise bearing the same association with the second hole as the third hole bears to the first hole whereby the web may be loaded in the machine with the holes of either longitudinal side edge portion associated with the one or the other of the drive sprockets.

8. A web for use with a machine wherein it is fed longitudinally of itelf by a pair of drive sprockets rotatable about a common axis and cooperating with holes in its two longitudinal side edge portions, the drive sprockets each having a circumferential series of uniformly spaced and radially outwardly extending pins with two of said pins, one on each sprocket and located in approximately the same plane containing said common axis, being visually distinguished from the other of said pins, said web comprising an elongated sheet-like member having parallel side edges and a length many times greater than its width, said web having a first row of uniformly spaced and uniformly shaped first holes located on a first straight line spaced slightly laterally inwardly from and extending parallel to one side edge of said web, a second row of uniformly spaced and uniformly shaped second holes located on a second straight line spaced slightly laterally inwardly from and extending parallel to the other side edge of said web, said web having a work area located between said first and second rows of holes which work area is completely uniform along the entire length of the web so as to be adapted to have a graphic generated thereon along any selected longitudinal portion thereof, and means appearing periodically along the lengths of said first and second rows of holes for visually distinguishing from the other of said first and second holes pairs of said first and second holes located on approximately the same line perpendicular to the side edges of said web so that a pair of such visually distinguished first and second holes may be placed on said two visually distinguished sprocket pins to obtain a predetermined relationship between the sprockets and said web, said means for visually distinguishing pairs of said first and second holes being for each such visually distinguished pair of first and second holes no more than two extra holes in said web located on said first line adjacent the distinguished one of said first holes and no more than two extra holes in said web located on said second line adjacent the distinguished one of said second holes, said extra holes being of the same size and shape as said first and second holes, there being no holes on said first line between the periodic appearances of said extra holes other than a plurality of said first holes and there being no holes on said second line between the periodic appearances of said extra holes other than a plurality of said second holes.

9. A web as defined in claim 8 further characterized by said means for visually distinguishing pairs of said first and second holes being for each such visually distinguished pair of first and second holes two extra holes in said web on said first line on opposite sides of the first hole of said visually distinguished pair and two extra holes in said web on said second line on opposite sides of the second hole of said visually distinguished pair, all of said extra holes being of the same size and shape as said first and second holes.

10. A method of loading a web onto a machine wherein it is fed longitudinally of itself by a pair of feed sprockets cooperating with holes in the web's two longitudinal side edge portions, said method comprising the steps of:

providing a machine with a pair of feed sprockets rotatable about a common axis and each having a circumferential series of uniformly spaced and radially outwardly extending pins with two of said pins, one on each sprocket and located in approximately the same plane containing said common axis, being visually distinguished from the other of said pins, providing a web consisting of an elongated sheet-like member having parallel side edges and a length many time greater than its width, said web having a first row of uniformly spaced and uniformly shaped first feed holes located on a first straight line spaced slightly laterally inwardly from and extending parallel to on side edge of said web, a second row of uniformly spaced and uniformly shaped second feed holes located on a second straight line spaced slightly laterally inwardly from and extending parallel to the other side edge of said web, said first and second feed holes being so sized, shaped and spaced along said first and second lines as to be cooperable with said pins of said sprockets to feed said web longitudinally of itself when said sprockets are rotated about said common axis, said web having a work area located between said first and second rows of feed holes which work area is completely uniform along the entire length of the web so as to be adapted to have a graphic generated thereon along any selected longitudinal portion thereof, and means appearing periodically along the length of said first and second rows of holes for visually distinguishing from others of said first and second feed holes pairs of said first and second feed holes located on approximately the same line perpendicular to the side edges of said web, said means for visually distinguishing pairs of said first and second feed holes being for each such visually distinguished pair of first and second feed holes no more than two extra holes located on said first line adjacent the distinguished one of said first feed holes and no more than two extra holes located on said second line adjacent the distinguished one of said second feed holes, there being no holes on said first line between the periodic appearances of said extra holes except for a plurality of said first holes and there being no holes on said second line between the periodic appearances of said extra holes except for a plurality of said second holes, said extra holes being of the same size and shape as said first and second holes, and placing a pair of such visually distinguished first and second feed holes on said two visually distinguished pins of said sprockets to establish a predetermined relationship between said sprockets and said web.

11. An elongated web having parallel side edges, a length many times greater than its width, two longitudinally extending side edge portions each located adjacent a respective one of said side edges, a longitudinally extending work area located between said side edge portions and completely uniform along the entire length of said web so as to be adapted to have a graphic generated thereon along any selected longitudinal portion thereof, two rows of feed holes each located in a respective one of said side edge portions of said web, the feed holes of each of said rows being located on a straight line parallel to said side edges of said web and being continuously regularly spaced from one another along said line by a uniform distance d so that one of said feed holes appears in each of said rows for each increment of length d of said web, and a plurality of appearances of indicator holes in each of said side edge portions which indicator holes are located on the same straight line as said feed holes of that side edge portion, said appearances of indicator holes in each side edge portion being spaced from one another by a distance at least three times greater than said distance d and there being no holes other than a plurality of said feed holes on either of said straight lines between said appearances of said indicator holes so that each appearance of said indicator holes visually distinguishes one of said feed holes from other of said feed holes, and each of such visually distingiushed feed holes of one side edge portion being located substantially directly opposite a visually distinguished one of the feed holes of the other side edge portion so that the line defined by the centers of said two visually distinguished feed holes extends substantially perpendicularly to said side edges.

12. An elongated web as defined in claim 11 further characterized by said feed holes and said indicator holes all being of the same size and shape.

13. An elongated web having parallel side edges, a length many times greater than its width, two longitudinally extending side edge portions each located adjacent a respective one of said side edges, a longitudinally extending work area located between said side edge portions and completely uniform along the entire length of said web so as to be adapted to have a graphic generated thereon along any selected longitudinal portion thereof, two rows of feed holes each located in a respective one of said side edge portions of said web, the feed holes of each of said rows being located on a straight line parallel to said side edges of said web and being continuously regularly spaced from one another along said line by a uniform distance d so that one of said feed holes appears in each of said rows for each increment of length d of said web, and a plurality of pairs of indicator holes in each of said side edge portions which indicator holes are located on the same straight line as said feed holes of that side edge portion, the two indicator holes of each of said indicator hole pairs being located on opposite sides of an indicated one of said feed holes with each of said indicator holes further being located between said indicated one of said feed holes and the next adjacent one of said feed holes, said pairs of indicator holes of each side edge portion being spaced from one another by a distance at least three times greater than said distance d, there being no holes other than a plurality of said feed holes on said straight lines between said pairs of indicator holes, and each of said pairs of indicator holes of one side edge portion being located substantially directly opposite a pair of indicator holes of the other side edge portion so that the line defined by the centers of the two feed holes indicated by said two pairs of susbtantially directly opposite indicator holes extends substantially perpendicularly to said side edges.

14. An elongated web as defined in claim 13, further characterized by the two indicator holes of each of said pairs of indicator holes being spaced different distances from the feed hole indicated thereby, the arrangement of the four indicator holes of two substantially directly opposite pairs of indicator holes being such that the two indicator holes which are closer to their indicated holes are spaced the same distance from said indicated feed holes but are located on opposite sides of said line defined by the centers of the indicated feed holes and such that the two indicator holes which are farther from their indicated feed holes are spaced the same distance from their indicated feed holes but are located on opposite sides of said line defined by the centers of the indicated feed holes.

* * * * *